United States Patent [19]

Linssen et al.

[11] Patent Number: 5,010,373

[45] Date of Patent: Apr. 23, 1991

[54] APPARATUS FOR SUPPLYING AND DISCHARGING ORIGINALS IN A COPYING MACHINE

[75] Inventors: Johannes L. J. M. Linssen, Baarlo; Jozef J. A. Pleyers, Panningen, both of Netherlands

[73] Assignee: Oce Nederland B.V., Netherlands

[21] Appl. No.: 550,390

[22] Filed: Jul. 10, 1990

[30] Foreign Application Priority Data

Jul. 14, 1989 [NL] Netherlands ..... 8901828

[51] Int. Cl.[5] ..... G03G 21/00

[52] U.S. Cl. ..... 355/319; 271/3.1; 271/9; 271/291; 271/902; 355/320; 355/309

[58] Field of Search ..... 271/3.1, 9, 291, 902; 355/308, 309, 317, 320, 319, 321

[56] References Cited

U.S. PATENT DOCUMENTS

| | | | |
|---|---|---|---|
| 4,231,561 | 11/1980 | Kaneko et al. | 355/319 X |
| 4,561,765 | 12/1985 | Masuda | 355/320 X |
| 4,639,125 | 1/1987 | Okuda et al. | 271/3.1 X |
| 4,814,822 | 3/1989 | Acquaviva et al. | 355/319 X |
| 4,819,023 | 4/1989 | Kitahara | 271/3.11 X |

FOREIGN PATENT DOCUMENTS

| | | | |
|---|---|---|---|
| 3631129 | 3/1987 | Fed. Rep. of Germany . | |
| 0108436 | 9/1978 | Japan | 355/320 |
| 1544045 | 4/1979 | United Kingdom . | |

OTHER PUBLICATIONS

Miller, "Second Job or Set Separator Device," IBM Tech. Disclosure Bulletin, vol. 22, No. 8B, 1/80-pp. 3591-3593.

*Primary Examiner*—A. T. Grimley
*Assistant Examiner*—William J. Royer
*Attorney, Agent, or Firm*—Reed Smith Shaw & McClay

[57] ABSTRACT

An apparatus for supplying and discharging originals in a copying machine is provided having a first and a second cassette for originals, a first feed path for feeding originals from the first cassette to the exposure station in a reversed orientation, a second feed path for feeding originals from the second cassette to the exposure station, a turnover path for turning over originals coming from the exposure station and returning them to the exposure station in a reversed orientation, a first discharge path for discharging originals from the exposure station to the first cassette in a reversed orientation and control unit for controlling the transport of the originals and a second discharge path to feed originals from the exposure station to the second cassette. The second feed path as well as the second discharge path are so formed that an original is not reversed in respect of orientation. The control unit is so constructed that duplex originals in the first up to and including the penultimate flow cycle are fed from one cassette to the other and simplex originals, at least from the second flow cycle, are conveyed from the same cassette to the exposure station.

10 Claims, 2 Drawing Sheets

APPARATUS FOR SUPPLYING AND DISCHARGING ORIGINALS IN A COPYING MACHINE

FIELD OF THE INVENTION

The present invention relates to an apparatus for supplying and discharging originals in a copying machine.

BACKGROUND OF THE INVENTION

Copying machines in which sets of originals are automatically recirculated and which are suitable for processing both simplex originals and duplex originals, i.e. originals provided with information on one or both sides respectively, to form simplex or duplex copies, are required to satisfy an extensive range of requirements by users. This range or requirements includes: simplest possible procedure for all combinations for processing simplex or duplex originals to form simplex or duplex copies; a readily visible and clear operating situation; a compact construction; good accessibility to the feed, turnover and discharge paths and also to the cassettes; and of course optimal productivity of the machine.

With regard to the operating situation aspect, this must be optimal in order to avoid any confusion on the part of the operator, e.g. during clearing and repairing a fault in the transport of the originals. A good aid in such a situation would be that the sequence of the originals in the cassettes during the processing of the copying order should always agree with the original sequence of the set of originals. With regard to productivity, it is desirable, particularly for high-speed copying machines, that it should be possible to insert in readiness at least one subsequent set of originals for the most usual copying orders, which are still the processing of simplex originals.

An apparatus for supplying and discharging originals in a copying machine is disclosed in DE 36 31 129 Al. Although this known apparatus satisfies a number of the above requirements, it does so at the expense of complex circulation through feed, turnover and return paths for the originals, even for the simplest processing of simplex originals to simplex copies.

GB-1,544,045 discloses a similar apparatus in which, although it uses less complex original flow paths, the sequence and orientation of the originals in the set in the case of duplex originals is changed between the first and second cassettes. The operator is thus faced with a confusing situation when clearing a malfunction in the original flow. Depending upon which cassette is to be used for deposition of the duplex originals, a specific sequence and a specific orientation (with the first image side up or down) must be selected. To enable simplex originals to be processed to form copy sets with a logical sequence of the copy sheets, they must be placed in the second cassette in the logical sequence, with page 1 at the top, or be placed in the first cassette but, in that case, so that the image-bearing sides are face down and the first sheet is at the top.

U.S. Pat. No. 4,231,561 describes an automatic document feeder for use in a duplex copying machine. This feeder is not suited for handling simplex originals and has several of the disadvantages mentioned above. U.S. Pat. No. 4,814,822 discloses a copier used for producing booklet form copysets. As such, it is designed to present the original sheets in the required "two-up" mode and is not well suited for handling a wide variety of originals.

All in all, this is an operating situation which readily results in mistakes and hence incorrect processing of the copying order.

It would be desirable therefore to provide an apparatus for supplying and discharging originals in a copying machine wherein the originals are always in the original sequence in the cassettes, and the simplest possible flow path is achieved for the processing of each original type, while in addition the next set of simplex originals can be placed in readiness while one set of simplex originals is actually being processed.

SUMMARY OF THE INVENTION

Generally, the present invention provides an apparatus for supplying and discharging originals in a copying machine having a first cassette and a second cassette for originals; a first feed path for feeding originals from the first cassette to an imaging means of the copying machine and so formed that the originals are fed to the imaging means in a reversed orientation; a second feed path for feeding originals from the second cassette to the imaging means; a turnover path for turning over originals coming from the imaging means and returning them to the imaging means; a first discharge path for discharging originals from the imaging means to the first cassette and so formed that the originals are deposited in the first cassette in a reversed orientation; and a control means for controlling the transport of the originals, wherein the improvement comprises: the second feed path being so formed that the originals are fed to the imaging means in the same orientation as they had in the second cassette; a second discharge path is provided to discharge originals from the imaging means to the second cassette and is so formed that originals are deposited in said cassette in the same orientation as they had when leaving the imaging means; and wherein the control means is so constructed that: (a) duplex originals, at least in the production of the first up to and including the penultimate set of copies, are fed from the cassette in which they are situated to the imaging means and, after both sides have been copied, are discharged to the other cassette, and (b) simplex originals, at least in the production of the second up to and including the last set of copies, are fed from the same cassette to the imaging means.

In another embodiment of the apparatus according to the present invention, one of the cassettes is provided with one or more set separating means known per se so that at least two sets of simplex originals can be placed in this cassette, separated from one another by one of the set separating means, and the control means are so constructed that the originals of a set of simplex originals are transported, in a first flow cycle, from said cassette to the other cassette via the associated feed path, the imaging means, the turnover path, the imaging means again and finally the associated discharge path. In this way it is possible to place a number of sets of simplex originals in readiness in one of the cassettes. By pre-programming the copying order for each set, the copying machine can process these original sets consecutively without any further intervention on the part of the operator.

A set of originals for which the programmed copying order has been processed in this embodiment of the apparatus according to the present invention is finally discharged to the cassette equipped with set separating means, where it is separated from the original set therebeneath by a set separating means, or discharged to an extra receiving tray used solely for collecting processed sets of originals.

Other details, objects and advantages of the present invention will become apparent as the following description of the presently embodiment of practicing the invention proceeds.

BRIEF DESCRIPTION OF THE DRAWINGS

In the accompanying drawings, preferred embodiments of the present invention are illustrated wherein.

DETAILED DESCRIPTION OF THE INVENTION

Figure 1:
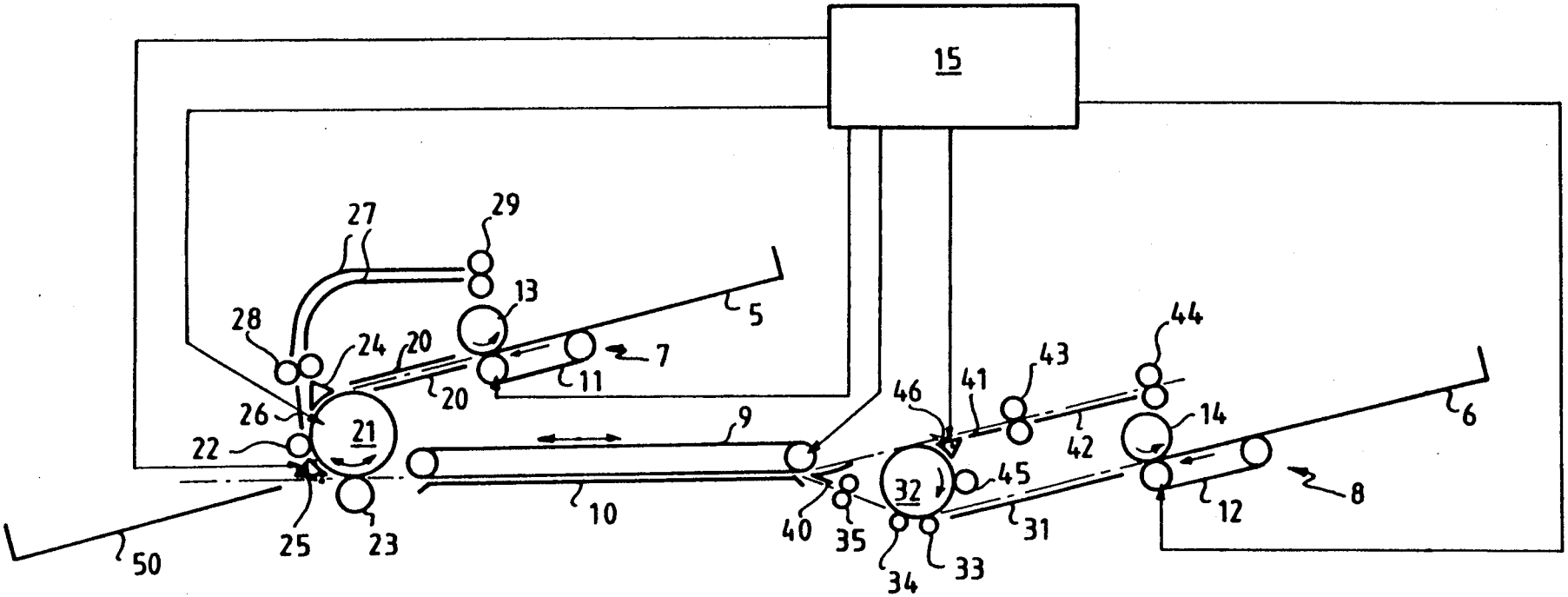
FIG. 1 is a diagram showing a supply and discharge apparatus according to the present invention for originals.

The apparatus shown in FIG. 1 for supplying and discharging originals comprises a first cassette 5, a second cassette 6, sheet separation mechanisms 7 and 8, respectively, know per se and cooperating with said cassettes, and a conveyer belt 9 which feeds the originals to and from the exposure station 10 of a copying machine. The sheet separation mechanisms 7 and 8 each consist of a conveyer belt 11, 12, respectively, which can take an original from the bottom of a stack of originals, and a contrarotating conveying roller 13, 14, respectively, which prevents more than one original from being simultaneously taken from the respective cassette 5, 6.

The apparatus also comprises a number of conveying and guide means and deflector elements which together form the feed and discharge paths between the cassettes 5, 6 and the exposure station 10, and a control means 15 with which the originals can be fed as required through said feed and discharge paths.

The first feed path, which leads from the first cassette 5 to the exposure station 10, is formed by guide means 20, a conveyer roller 21, two rollers 22 and 23 cooperating therewith, and deflector members 24 and 25. This feed path is formed so that the orientation in which an original is fed to the imaging means is reversed with respect to the orientation in which the original was situated in the first cassette.

The first discharge path from the exposure station 10 to the first cassette 5 consists of a part of the first feed path (conveyer roller 21 with rollers 22, 23 and deflector member 25), guide means 26, 27 and conveyer roller pairs 28 and 29. An original conveyed through this discharge path is deposited in the first cassette in an orientation which is reversed with respect to the orientation in which the original was situated at the imaging means.

A second feed path extending between the second cassette 6 and the exposure station 10 is formed by guide means 31, a conveyer roller 32, two rollers 33 and 34 cooperating therewith and conveyer roller pair 35. A second discharge path through which originals are again conveyed from the exposure station 10 to the second cassette 6, consists of a deflector member 40, guide means 41 and 42 and conveyer roller pairs 43 and 44. The second feed path and the second discharge path are formed so that the orientation in which an original is fed to the imaging means or is deposited in the second cassette, respectively, is the same as the orientation in which the original was situated in the second cassette. A turnover path for the originals is disposed directly adjacent the exposure station 10 and is formed by the deflector member 40, conveyer roller 32 including the rollers 33, 34 and 45 cooperating therewith, a deflector member 46 and, finally, conveyer roller pair 35.

The deflector member 46 is movable, by means of an operating member (not shown), from the solid-line position to the broken-line position and vice versa. In the broken-line position, the deflector member 46 forms an operative part of the turnover path through which the original is fed from the second discharge path to the rest of the turnover path.

Finally, a third discharge path from the exposure station 10 to a receiving tray 50 is formed by the conveyer nip of the rollers 21 and 23, and the bottom of the deflector member 25. Deflector member 25, like deflector member 46, is movable between a first position (shown in solid lines) and a second position (shown in broken lines). In the first position, an original coming from the exposure station 10 is passed to the receiving tray 50 while in the second position an original is deflected into the first discharge path.

Figure 2:
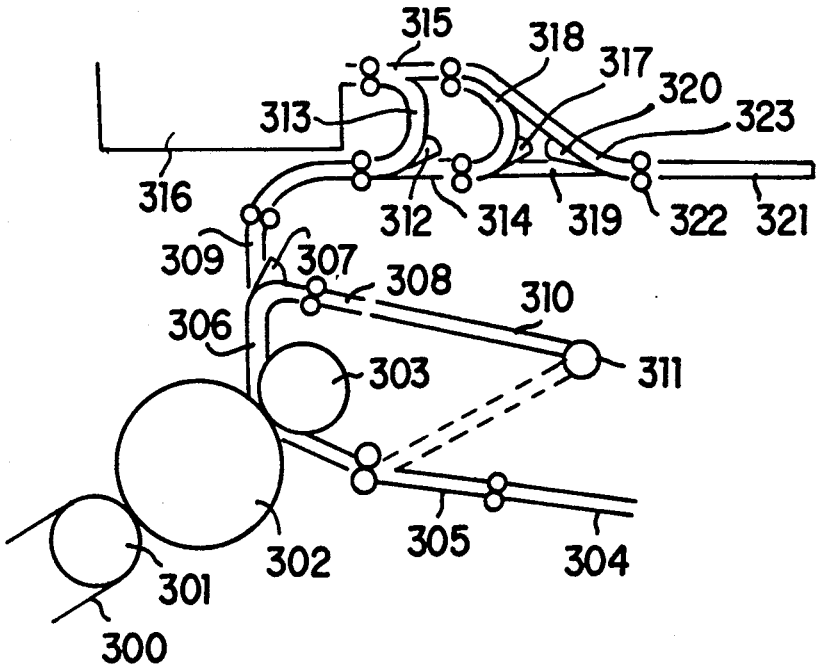
FIG. 2 is a diagram showing the image transfer means and the copy transport in a copying machine equipped with the apparatus shown in FIG. 1.

FIG. 2 shows an embodiment of the image transfer means and the copy conveyance means of the kind that can be used in a copying machine equipped with the apparatus shown in FIG. 1. The photoconductive belt 300 on which the image to be transferred is present is fed over pressure roller 301 into the image transfer station. In the image transfer station a roller 302 which picks up the powder image and which is provided with a soft, resilient external covering (not shown) and which is heated by heating means (not shown), presses against the photoconductive belt 300. The roller 302 cooperates with a pressure roller 303 which is similarly provided with a soft, resilient external covering. A sheet of unprinted receiving material is fed via the guides 304 and 305 into the nip between rollers 302 and 303 and there picks up the image from roller 302. After the nip between rollers 302 and 303 is the entrance to a guide 306 which opens out at switch 307 into a guide 308 and a guide 309. Guide 308 opens out into a holder 310 which can swivel around a shaft 311 until the position shown by the dotted lines, as a result of which a sheet printed on one side which is fed therein can again be fed via guide 305 into the nip between rollers 302 and 303 for printing on the as yet unprinted side. At the switch 312, the guide 309 opens out into guides 313 and 314, of which guide 313 opens out into guide 315 which in turn terminates in a collector tray 316. At switch 317, the guide 314 changes into a guide 318 which opens out into guide 315, and a guide 319 which at a freely-movable switch 320 changes into a guide 321. Guide 321 is provided with transport means 322, whose direction of transport can be reversed, by means of which a copy fed therein can be fed to the collector tray 316 via guides 323 and 315.

The flow of originals through the apparatus shown in FIG. 1 will now be described for the different possibilities of processing simplex or duplex originals to form simplex or duplex copies.

In the processing of simplex originals to form simplex or duplex copies, the set of originals is placed with the image side down in the first or second cassette 5 or 6, respectively. Starting from the cassette 6, the originals are taken one by one by the sheet separation mechanism 8 from the cassette 6 and fed via guide means 31, beneath conveyer roller 32 and via conveyer roller pair 35 to the conveyer belt 9.

This conveyer belt 9 transports the original over a distance determined by the control means 15 until the original has reached the position required for exposure in the exposure station 10. The drive for the conveyer belt 9 is then interrupted until exposure is complete. The belt 9 is then driven in the reverse direction and the original is returned to the cassette 6. Coming from the exposure station 10 the original is fed by deflector member 40 to the second discharge path, after which it reaches cassette 6 via conveyer roller 32, conveyer roller pairs 43 and 44, and guide means 41, 42. In this way the complete set of originals is circulated and exposed one by one until the copying order is complete.

Starting from the first cassette 5, simplex originals are supplied one by one by the sheet separation mechanism 7 and via guide means 20, deflector member 24, conveyer roller 21 and rollers 22, 23 cooperating therewith, and deflector member 25 to the exposure station 10. The conveyer belt 9 now conveys the original through the exposure station 10 and via the turnover path back to the exposure station 10, the original being turned over to bring the image side down.

After exposure, the originals are then fed by the conveyer belt 9 into the second discharge path so that they are deposited in the second cassette 6. The rest of the copying order is then completed as described hereinabove in respect of processing from cassette 6. The simplex copies made from simplex originals are fed to the collecting station 316 in the copy conveying part as shown in FIG. 2, via guides 306, 309, 313 and 315.

For processing duplex originals to duplex or simplex copies, the originals are placed in the second cassette 6 in the logical sequence, with the first image side down. For processing duplex originals to simplex copies, an original is separated by separation mechanism 8 and fed via the second feed path to the conveyer belt 9, whereafter the original is conveyed through the exposure station 10 until it reaches the required exposure position. Exposure of the first image side then takes place, whereafter the original is fed from the exposure station 10 and then returned to the latter via the turnover path. The original thus now has the second image side down in the exposure station 10 and this second image side is exposed. After exposure of both image sides the original is deposited in the first cassette 5 via the first discharge path. A complete set of originals is processed in this way and deposited in the cassette 5, the original sequence of the originals being maintained. The simplex copies are fed to the collecting station 316 (see FIG. 2) via the guides 306, 309, 313 and 315.

In a second copying cycle of the same set of originals, the operation now takes place from cassette 5. An original is fed via the first feed path to the exposure station 10, but with the second image side face down. In order to obtain a correct processing sequence for the copies, the original is first conveyed through the exposure station 10 and fed back via the turnover path in order to enable the first image side to be exposed first. The original is then again turned over via the turnover path to enable the second image side to be exposed. After exposure of both image sides, the original is again conveyed through the turnover path for deposition in the second cassette 6 via the second discharge path in the correct orientation (i.e. with the first image side down). The simplex copies are again deposited in the collection station 316 (see FIG. 2) via the guides 306, 309, 313 and 315.

Thus in this method of processing duplex originals to form simplex copies, the operation always starts from cassette 6, processing taking place in odd flow cycles from cassette 6 to cassette 5 and in even flow cycles from cassette 5 to cassette 6. In order to create a clear situation for the copying machine operator in every case, the control means 15 of the copying machine is so constructed that after the last flow cycle of the copying order the set of originals always finishes up in the second cassette 6. In the case of a copying order with an odd number of flow cycles, this means that an extra flow cycle is necessary (without exposure). In this cycle the originals from the first cassette 5 are returned in the correct orientation to cassette 6 via the first feed path, the exposure station 10, the turnover path, the exposure station 10 again and the second return path.

For processing duplex originals to simplex copies, the above-described processing method can be simplified somewhat by omitting a turning over step of the originals in the even flow cycles, i.e. the cycles in which the duplex originals are fed from the cassette 5. In this case, a duplex original from the cassette 5 is conveyed via the first feed path to the exposure station 10 where the second image side is first exposed. The original is then fed back to the exposure station 10 via the turnover path in order to expose the first image side. This procedure eliminates the turnover movement prior to the first exposure while after exposure of the two image sides no turnover movement is required to deposit the original in the cassette 6 in the correct orientation.

In the apparatus shown in FIG. 2, the copy transport in this case is such that the first simplex copy made is conveyed via guides 306, 309, 314, 318 and 315, while the second simplex copy derived from the same duplex original is conveyed along the shorter path 306, 309, 313 and 315, so that the correct copy sequence is achieved in the collecting station 316.

For processing duplex originals to form duplex copies, the originals are placed in cassette 6 at the start of the copying order in the same way as described hereinbefore. The flow of originals is also as described above, i.e. from cassette 6 to the exposure station and, after both sides have been copied, discharge to cassette 5 via the first discharge path. The duplex copies are fed to the collecting station 316 via the guides 306, 309, 314, 319, 321, 323, and 315 (see FIG. 2).

The flow of originals from cassette 5 is preferably the same as in the simplified processing method described above, i.e. from cassette 5 via the first feed path to the exposure station 10, where first of all the second image side is copied. Then back via the turnover path to the exposure station 10 where the first image side is then copied, and finally via the second discharge path to the cassette 6. The duplex copies are now deposited in the collecting station 316 via the guides 306, 309, 313 and 315 (see FIG. 2).

In another embodiment of the apparatus according to the present invention, the first cassette 5 can be provided with one or more set separating means known from the art. The IBM Technical Disclosure Bulletin, Volume 22, No. 8B (Jan. 1980) at pages 3591–93, for example, describes the use of mechanical set separating means. With this configuration, at least two sets of simplex originals can be deposited in this cassette 5, being separated from one another by one of the set separating means. Thus, for processing sets of simplex originals the apparatus according to the present invention has the advantage that a number of copying orders can be preprogrammed, after which the control means 15 further executes these orders without the intervention of the operator. With this processing method, the first (bottom) set of originals is conveyed original by original via the first feed path, the exposure station 10, the turnover path, the exposure station again and the second discharge path to the second cassette 6 to be processed therefrom as already described hereinbefore. After the last exposure of each original, the original is not returned to cassette 6 but deposited in the receiving tray 50 via the third discharge path. In order to keep the original sets separated from one another in this receiving tray 50, the latter should be displaceable or turnable between consecutive sets of originals by means known from the art.

The control means 15 may also be so constructed that duplex originals are also deposited in the receiving tray 50 after the last exposure cycle. Simplex originals can be discharged directly from the exposure station 10 to the receiving tray 50, while after an even flow cycle this also applies to duplex originals processed to form duplex copies. In the case of duplex originals, however, an extra turnover movement may be necessary in order to deposit the set of originals in the receiving tray 50 in the correct sequence and orientation. In those cases, the duplex originals from the exposure station 10 are returned to the exposure station 10 via the turnover path and directly thereafter are discharged via the third discharge path.

The above illustration of the operation of the apparatus embodying the present invention is based on a copying situation in which the sets of originals to be copied are processed in the face-down situation, i.e., at the start of a copying order the originals are placed in the corresponding cassette in the logical sequence and with page 1 facing the bottom of the cassette. The insertion of the set of duplex or simplex originals at the start of a copying order is then as illustrated in cassette 6.

For processing sets of simplex originals, the subsequent sets of simplex originals can then be placed in the cassette 5 again in the face-down orientation. As already described, the cassette 5 may be provided with set separating means in order to keep the various sets of originals separated from one another. Even if the cassette 5 is not provided with set separating means, a number of sets of simplex originals can be placed in the cassette 5. The copying machine should then be so controlled in known manner that the operator in preprogramming each copying order can indicate the number of sheets in the set of originals inserted.

The apparatus according to the present invention and as illustrated diagrammatically in FIG. 1 can also be used for copying situations in which a face-up insertion of sets of originals is used, i.e., the originals are inserted in the logical sequence with page 1 at the top. In that case, cassette 5 is used for the insertion of a set of originals at the start of a copying order, while cassette 6 which, for this purpose, can be provided with set separating means can then be used for the insertion of sets of simplex originals, to be preprogrammed. For the copy transport in this case use can also be made of a construction as shown in FIG. 2, but the control of the copy transport paths is such that the simplex copies are fed to the collecting station 316 via the guides 306, 309, 314, 319, 321, 323 and 315. For copying duplex originals to simplex copies, the above-described simplified original processing method can be performed with each even flow of originals, wherein a duplex original is fed from cassette 6 via the second feed path to the exposure station 10 where the second image side is copied, then returned to the exposure station 10 via the turnover path for copying of the first image side, and then discharged via the first discharge path to the cassette 5. The correct copy sequence can then be restored by temporarily storing the first simplex copy (i.e. the copy of the second image side of the duplex original) in one of the guides 309, 314, 319, 321, 323 or 315 e.g. by holding it fast against the bottom guide plate by suction from a suction means, and then transporting it further, together with the next simplex copy supplied over it, or else not transporting it further until the next simplex copy has been transported. Duplex copies of simplex originals are fed to the collecting station 316 via the guides 306, 309, 314, 319, 321, 323 and 315. Duplex copies of duplex originals are discharged via guides 306, 309, 313 and 315 on each odd flow of originals and via the guides 306, 309, 314, 319, 321, 323 and 315 on each even flow of originals.

In order that the operating situation of the supply and discharge apparatus for originals may be simplified further for a less skilled operator, the apparatus can be so constructed that the cassette in which the first set of originals should be inserted at the start of the copying order is open and freely accessible while the other cassette in which the next sets of simplex originals to be preprogrammed should be inserted is closed by a movable lid. If required, the movement of the lid can be mechanized so that the cassette is closed when the machine is ready for operation and is automatically opened when the operator starts a preprogrammed order or, if necessary, in the event of a fault in the flow of originals.

While a presently preferred embodiment of practicing the invention has been shown and described with particularity in connection with the accompanying drawings, the invention may be otherwise embodied within the scope of the following claims.

What is claimed is:

1. In an apparatus for supplying and discharging originals in a copying machine comprising: a first cassette and a second cassette for originals; a first feed path for feeding originals from the first cassette to an imaging means of the copying machine and so formed that the originals are fed to the imaging means in a reversed orientation; a second feed path for feeding originals from the second cassette to the imaging means; a turnover path for turning over originals coming from the imaging means and returning them to the imaging means; a first discharge path for discharging originals from the imaging means to the first cassette and so formed that the originals are deposited in the first cassette in a reversed orientation; and a control means for controlling the transport of the originals; the improvement comprising: the second feed path being so formed that the originals are fed to the imaging means in the same orientation as they had in the second cassette; a second discharge path is provided to discharge originals from the imaging means to the second cassette and is so formed that originals are deposited in the second cassette in the same orientation as they had when leaving the imaging means; and wherein the control means is so constructed that: (a) duplex originals, at least in the production of the first up to and including the penultimate set of copies, are fed from the cassette in which they are situated to the imaging means and, after both sides have been copied, are discharged to the other cassette, and (b) simplex originals, at least in the production of the second up to and including the last set of copies, are fed from the same cassette to the imaging means.

2. An apparatus as described in claim 1, wherein one of the cassettes is provided with one or more set separating means so that at least two sets of originals can be placed in this cassette, being separated from one another by one of the set separating means; and the control means causes the originals of a set of originals to be fed, in the first flow cycle, from said cassette to the other cassette via the corresponding feed path, the imaging means, the turnover path the imaging means again and the corresponding discharge path.

3. An apparatus as described in claim 1 further comprising a receiving tray and a third discharge path for discharging originals from the imaging means to the receiving tray and wherein the control means causes the originals in the last flow cycle of a copying order to be fed from the imaging means via the third discharge path to the receiving tray.

4. An apparatus as described in claim 1, wherein the control means causes duplex originals in the case of a copying order having an odd number of flow cycles to be discharged, in the last flow cycle, via, successively, the turnover path, the imaging means and the corresponding discharge path to the cassette in which they were placed at the start of the copying order.

5. An apparatus as described in claim 2 further comprising a receiving tray and a third discharge path for discharging originals from the imaging means to the receiving tray and wherein the control means causes the originals in the last flow cycle of a copying order to be fed from the imaging means via the third discharge path to the receiving tray.

6. An apparatus as described in claim 1 wherein the turnover path is formed by a connecting path between the second discharge path and the second feed path.

7. An apparatus as described in claim 2 wherein the turnover path is formed by a connecting path between the second discharge path and the second feed path.

8. An apparatus as described in claim 3 wherein the turnover path is formed by a connecting path between the second discharge path and the second feed path.

9. An apparatus as described in claim 4 wherein the turnover path is formed by a connecting path between the second discharge path and the second feed path.

10. An apparatus as described in claim 5 wherein the turnover path is formed by a connecting path between the second discharge path and the second feed path.

* * * * *